US009670053B2

(12) United States Patent
Graf

(10) Patent No.: US 9,670,053 B2
(45) Date of Patent: Jun. 6, 2017

(54) APPARATUS AND METHOD FOR TRANSFERRING SPRINGS WITH TRANSPORT WHEEL

(75) Inventor: Roland Graf, St. Gallen (CH)

(73) Assignee: SPUEHL AG, Wittenbach (CH)

( * ) Notice: Subject to any disclaimer, the term of this patent is extended or adjusted under 35 U.S.C. 154(b) by 1225 days.

(21) Appl. No.: 13/503,790

(22) PCT Filed: Oct. 22, 2010

(86) PCT No.: PCT/EP2010/006474

§ 371 (c)(1),
(2), (4) Date: Jun. 21, 2012

(87) PCT Pub. No.: WO2011/050929

PCT Pub. Date: May 5, 2011

(65) Prior Publication Data

US 2012/0275895 A1 Nov. 1, 2012

(30) Foreign Application Priority Data

Oct. 27, 2009 (EP) ..... 09013531

(51) Int. Cl.
*B68G 9/00* (2006.01)
*B21F 35/00* (2006.01)

(52) U.S. Cl.
CPC ..... *B68G 9/00* (2013.01); *B21F 35/00* (2013.01)

(58) Field of Classification Search
CPC ..... B68G 9/00; B21F 35/00
See application file for complete search history.

(56) References Cited

U.S. PATENT DOCUMENTS

| | | | | |
|---|---|---|---|---|
| 4,413,659 | A | 11/1983 | Zängerle | |
| 4,653,185 | A | 3/1987 | Kajima et al. | |
| 4,764,179 | A | 8/1988 | Yajima | |
| 5,386,622 | A | 2/1995 | Susaki et al. | |
| 5,579,810 | A * | 12/1996 | Ramsey | B68G 9/00 140/3 CA |
| 5,792,309 | A | 8/1998 | Eto | |
| 5,950,473 | A | 9/1999 | Andrea et al. | |
| RE36,809 | E * | 8/2000 | Ramsey | B68G 9/00 140/3 CA |
| 6,119,322 | A * | 9/2000 | Eto | B21F 33/04 29/33 E |

(Continued)

FOREIGN PATENT DOCUMENTS

| | | |
|---|---|---|
| CN | 201288056 Y | 8/2009 |
| DE | 3700618 | 7/1988 |

(Continued)

*Primary Examiner* — Gerald McClain
(74) *Attorney, Agent, or Firm* — Michael Best & Friedrich LLP

(57) ABSTRACT

An apparatus for transferring springs to a spring conveyor comprises a transfer device and an output device. The transfer device is mounted such that it can be moved between a plurality of positions in which the transfer device is respectively configured to receive a spring, and is configured to transport a received spring during movement of the transfer device between the plurality of positions. The output device is configured to selectively output the spring received by the transfer device from the transfer device at one of plural output positions, wherein the plural output positions are pairwise different.

18 Claims, 4 Drawing Sheets

(56) References Cited

U.S. PATENT DOCUMENTS

2005/0241720 A1* 11/2005 Widmer ..... B23Q 7/02
140/101

FOREIGN PATENT DOCUMENTS

| | | | | |
|---|---|---|---|---|
| EP | 0774310 | | | 5/1997 |
| EP | 1492637 | | | 6/2005 |
| EP | 1429978 | | | 4/2008 |
| JP | 4-44220 | U | | 4/1992 |
| JP | 9-85373 | A | | 3/1997 |
| JP | 9-173673 | A | | 7/1997 |
| JP | 2002079339 | A | * | 3/2002 |
| WO | 00/15369 | | | 3/2000 |
| WO | 00/47348 | | | 8/2000 |
| WO | 03/029111 | | | 4/2003 |
| WO | 2004/011173 | | | 2/2004 |
| WO | 2009/103173 | | | 8/2009 |

* cited by examiner

APPARATUS AND METHOD FOR TRANSFERRING SPRINGS WITH TRANSPORT WHEEL

CROSS REFERENCE TO RELATED APPLICATIONS

This application is a U.S. national phase application filing of International Patent Application No. PCT/EP2010/006474, filed Oct. 22, 2010, which claims the benefit of and priority to European Patent Application No. 09013531.0, filed Oct. 27, 2009, the entire contents of each of which are incorporated herein by reference.

The invention relates to an apparatus and a method for transferring springs to a spring conveyor. The invention relates in particular to an apparatus and a method for conveying springs to a spring conveyer, which apparatus or method can be used to transfer springs to a spring conveyor in a machine for producing a string of springs, in particular a string of pocket springs, or in an automatic system for producing a spring core or a pocket spring core. The invention relates in particular to an apparatus and a method which allows springs to be transferred from a spring former to a spring conveyor.

Machines or automatic systems are used for producing spring cores or pocket spring cores, which allow a high degree of automation to be attained when producing strings of springs, strings of pocket springs, spring cores or pocket spring cores. Such machines or automatic systems may have a spring former for producing springs and plural stations downstream of the spring former in which the springs may be rotated selectively, may be arranged in rows, may be pocketed and/or may be combined to a spring core or a pocket spring core, for example. The number and operation of the stations which are arranged downstream of the spring former may be different depending on the operation of the respective machine or the respective automatic system. In the machine or the automatic system, the springs are transported by a conveying device or plural conveying devices, which will be referred to as spring conveyer in the following, from the spring former to the stations of the machine or of the automatic system.

Machines or automatic systems for producing strings of springs, strings of pocket springs, spring cores or pocket spring cores frequently have a device which allows a spring to be transferred to a spring conveyor. Such a device may be provided for transferring springs from a spring former to a conveying belt or a pair of conveying belts, for example, which may convey the springs onward through the machine or the automatic system. Conventional devices for transferring springs are frequently configured such that an element or a pair of elements grips the spring and transfers it to the spring conveyor, and the element or the pair of elements has to be returned to an initial position after the spring has been transferred and before another spring can be transferred to the spring conveyor in a new working cycle. The return movement of the element or the pair of elements to its initial position increases the duration of each working cycle and may limit the cycle frequency of the machine or of the automatic system in which the springs are conveyed. Further, conventional devices for transferring springs frequently are configured such that the spring conveyor is driven in a clocked manner, as is the case for the conveyor described in U.S. Pat. No. 5,950,473, for example. For a given number of springs which are to be transported per time, the clocked operation requires that a sufficiently powerful, and correspondingly expensive, drive is provided to guarantee the required acceleration and deceleration of the conveyor.

WO 00/47348 A1 describes an apparatus for rotating and positioning springs formed on a spring coiling machine, in which push-in means engage end coils of springs to transfer the springs to a transport means, such as a pair of endless belts, which transfer the springs to a spring core assembly system. The push-in means are pivoted back to an initial position before a new working cycle starts.

EP 1 492 637 B1 describes a device for orienting springs which may have plural pairs of rotary plates which may be provided in a pair of rotary discs. A spring is transferred from a transport star of a spring coiling machine to a spring conveyor, with the spring being clamped between one of the pairs of rotary plates during transfer. The spring is output from the pair of rotary plates at a pre-determined position.

There is a need for an improved apparatus and an improved method for transferring springs to a spring conveyor. In particular, there is a need for such an apparatus and such a method which allows springs to be transferred with an increased rate. There is also a need for such an apparatus and such a method which allows springs to be transferred to a spring conveyor which is moved in a continuous fashion.

According to the invention, an apparatus and a method as defined in the independent claims are provided. The dependent claims define advantageous or preferred embodiments.

The apparatus and the method allow springs to be transferred to a spring conveyor. A spring conveyor is herein understood to be a device which allows a spring or plural springs to be transported. The spring conveyor may comprise separate elements to receive one or plural springs, a transport belt or a plurality of transport belts, a transport wheel or similar.

According to an aspect, there is provided an apparatus for transferring springs to a spring conveyor, in particular for a machine for producing a string of pocket springs, which apparatus comprises a transfer device and an output device. The transfer device is movable between a plurality of positions in which the transfer device is respectively configured to receive a spring. The transfer device is configured to transport a received spring when the transfer device is moved between two positions of the plurality of positions. The output device is configured to selectively output the spring received by the transfer device from the transfer device at one of plural output positions, with the plural output positions being pairwise different. Pairs of output positions may in particular be spaced from each other.

With the transfer device of the apparatus being configured such that it is configured to respectively receive a spring in the plurality of positions, the different positions of the plurality of positions may each serve as an initial position for a new working cycle. Because the received spring can be output from the transfer device at one of plural different output positions, the position in which a spring is output from the transfer device may in particular also serve as initial position of a new working cycle in which another spring is received by the transfer device. Thereby, a separate return step of the transfer device from the end position of one cycle to an initial position of the subsequent cycle may be omitted. The device is in particular also configured to transfer springs to a spring conveyor which moves continuously.

The transfer device may be configured to selectively transport the received spring in a first direction or in a second direction different from the first direction, in particular in a second direction opposite to the first direction. This configuration allows the transfer device to be moved reciprocatingly in opposite directions between the positions in an alternating manner, in particular between a first position and a second position. The spring may be transported in the first direction or in the second direction before it is output from the transfer device, depending on in which position of the plurality of positions it has been received by the transfer device.

The apparatus may be configured such that the transfer device may be moved between positions of the plurality of positions essentially parallel or essentially anti-parallel to a movement direction of the spring conveyor. This allows springs to be handed over to the spring conveyor over a short distance at different output positions.

The apparatus may be configured such that each output position of the plural output positions is associated with a position of the transfer device in which the spring that is output at the respective output position was received by the transfer device. This enables the transfer device to sequentially receive plural springs to be conveyed to a spring conveyor in the plurality of positions, which springs can be output in a well-defined manner at an output position which is associated with the respective receiving position. Thereby, an equidistant arrangement of springs on the spring conveyor may be easily attained, for example.

The apparatus may be configured such that the output device outputs the spring received by the transfer device while the transfer device concurrently receives another spring. For this purpose, a controller coupled to the output device may be provided which controls the output device as a function of the position in which the transfer device is positioned, such that the spring received by the transfer device is output from the transfer device while a new spring is received. Due to the temporal overlap of outputting a spring and receiving another spring, the rate at which springs may be transferred may be made even shorter.

The apparatus may be configured such that the transfer device has a first position and a second position and is configured to output a spring and to receive another spring in each one of the first position and the second position. The transfer device may be alternatingly moved between the first position and the second position. A spring which is received by the transfer device in the first position may be output from the transfer device at a first output position by the output device when the transfer device is in the second position. While the transfer device is in the second position, the transfer device may receive a second spring. The second spring received by the transfer device in the second position may be output from the transfer device at a second output position by the output device when the transfer device is again in the first position.

The apparatus may have retaining means to support the spring received by the transfer device in a form fit. The retaining means allow a spring to be retained on the transfer device during movement of the transfer device between positions of the plurality of positions. Additionally, the retaining means which support the spring in a form fit may also be operative to suppress oscillations of the spring when the spring is received in the transfer device, in particular when the spring is formed in the transfer device. The retaining means may be configured such that a resultant force exerted by the retaining means onto the spring is directed perpendicular to a longitudinal axis of the spring.

In another implementation, the apparatus may comprise retaining means to support the spring received by the transfer device by frictional locking.

The retaining means may be controllable to release the spring received by the transfer device as a function of a position of the plurality of positions in which the transfer device is located. The retaining means may in particular be configured such that a spring which is received by the transfer device in a first position is released when the transfer device is in the second position. The retaining means may be configured such that another spring which is received by the transfer device in the second position is released when the transfer device is in the first position. By virtue of this configuration, the spring received by the transfer device may be supported on the transfer device during movement of the transfer device and may be selectively released at one of plural output positions.

A transfer device may have a cavity for receiving the spring, with the retaining means comprising a wall section of a cavity which is displaceable relative to the cavity. The retaining means may in particular comprise a floor section of the cavity which is mounted so as to be displaceable relative to the transfer device. Thereby, locking of the received spring in a form fit can be attained using a simple construction, and the received spring can be brought into abutment with the floor section. The cavity may be defined by at least one pair of walls between which the cavity extends. The pair of walls may be provided so as to be spaced from each other, or the walls may be arranged at an angle relative to each other. In one implementation, the retaining means may comprise a trap-door mechanism which allows the spring received by the transfer device to pass therethrough at one of the plural output positions.

The transfer device may also comprise a plurality of cavities, wherein a spring can be received in each of the cavities. The number of cavities may correspond to the number of positions of the transfer device.

The apparatus may be configured such that a finished spring is supplied to a transfer device.

The apparatus may be configured such that the spring is formed in a cavity of the transfer device. For this purpose, the apparatus may comprise a spring coiling device which is configured such and which is arranged relative to the transfer device such that it winds a spring to be received by the transfer device in a cavity of the transfer device. In particular, the spring coiling device may comprise a coiling head which is arranged in a cavity of a plurality of cavities of the transfer device for each of the plurality of positions of the transfer device.

According to another aspect, a machine for producing at least one string of springs for a spring core is provided which comprises a spring conveyor for conveying springs and an apparatus for transferring the springs to the spring conveyor, with the apparatus for transferring springs being configured as apparatus according to an aspect or embodiment. In such an apparatus, use of the apparatus for transferring springs allows the springs to be transferred to the spring conveyor at a high rate. The apparatus allows springs to be transferred to a spring conveyor which moves continuously.

The machine may be configured as a machine for producing a string of pocket springs. The machine may accordingly comprise a pocketing device for pocketing the springs, to which the springs are transported by the spring conveyor.

The spring conveyor may be configured as a cooling wheel in which the springs cool down after a heat treatment of the wire from which the springs are formed or after a heat treatment of the springs before the springs are pocketed.

In the machine, the spring conveyor may move continuously. This allows the required accelerations and, thus, forces to be reduced in comparison to a clocked movement. Accordingly, the requirements imposed on the spring conveyor may be reduced such that a longer lifetime of the components may be attained and/or less expensive components may be used for the spring conveyor.

According to an aspect, there is provided a method for transferring springs to a spring conveyor, in particular for a machine for producing a string of pocket springs. In the method, a spring to be transferred is received by a transfer device which can be positioned in a plurality of positions, the transfer device is moved in order to transport the spring to be transferred, and the spring to be transferred is output from the transfer device. In this process, the spring to be transferred is selectively output at one of plural output positions, with the plural output positions being pairwise different from each other. The output positions may in particular be pairwise spaced from each other.

In this method, the position of the transfer device in which a spring is output from the transfer device may also act as initial position of a new working cycle in which another spring is received by the transfer device, because the received spring may be output from the transfer device at one of plural different output positions by the output device.

The spring to be transferred may be transported in a first direction or in a second direction different from the first direction, in particular in a second direction which is opposite to the first direction, depending on the position of the transfer device in which the spring to be transferred was received by the transfer device.

The spring to be transferred may be output from the transfer device while the transfer device concurrently receives another spring to be transferred. Thereby, a rate at which springs are transferred may be increased further.

The transfer device may be sequentially moved in opposition directions to transport the spring to be transferred and the other spring to be transferred.

The spring to be transferred may be supported on the transfer device in a form fit while the transfer device is moved. Retaining means for supporting the spring to be transferred in a form fit may be provided, which retaining means may already support the spring to be transferred while it is being formed.

For an explanation of the effects of the advantageous or preferred embodiments of the method of the invention, reference is made to the effects of the corresponding embodiments of the apparatus of the invention.

According to another aspect of the invention, there is provided an apparatus for transferring springs to a spring conveyor, in particular for a machine for producing a string of pocket springs, which apparatus comprises a transfer device and retaining means. The transfer device is configured to receive a spring and is moveable between a plurality of positions. The transfer device is configured to transport a received spring when the transfer device is moved between two positions of the plurality of positions. The retaining means are configured to support the spring received by the transfer device in a form fit while the transfer device is moved between two positions of the plurality of positions. The retaining means may further be configured so as to allow the spring received by the transfer device to be output from the transfer device when the transfer device has reached a desired position. The retaining means may be configured such that a force exerted by the retaining means onto the spring is directed perpendicular to a longitudinal axis of the spring.

The retaining means may comprise a wall section of a cavity which is mounted so as to be displaceable relative to the cavity which is defined by the transfer device. The retaining means may in particular comprise a trap-door mechanism which is selectively opened when the spring received by the transfer device is to be output from the transfer device.

The apparatus and methods according to various embodiments of the invention may generally be used to transfer springs to a spring conveyor. Transferring springs from a coiling head of a spring coiling machine to a spring conveyor is an exemplary field of use. Another field of use is transferring springs in a machine for producing strings of pocket springs. However, apparatus and methods are not limited to these fields of use.

The invention will be explained in more detail in the following by means of embodiments with reference to the accompanying drawing.

In the following, embodiments of the invention will be explained in more detail. The features of the various embodiments may be combined with each other unless this is explicitly excluded in the following description. While various embodiments will be described in the context of specific fields of use, such as in the context of a machine for producing a string of pocket springs, the present invention is not limited to these fields of use.

Figure 1:
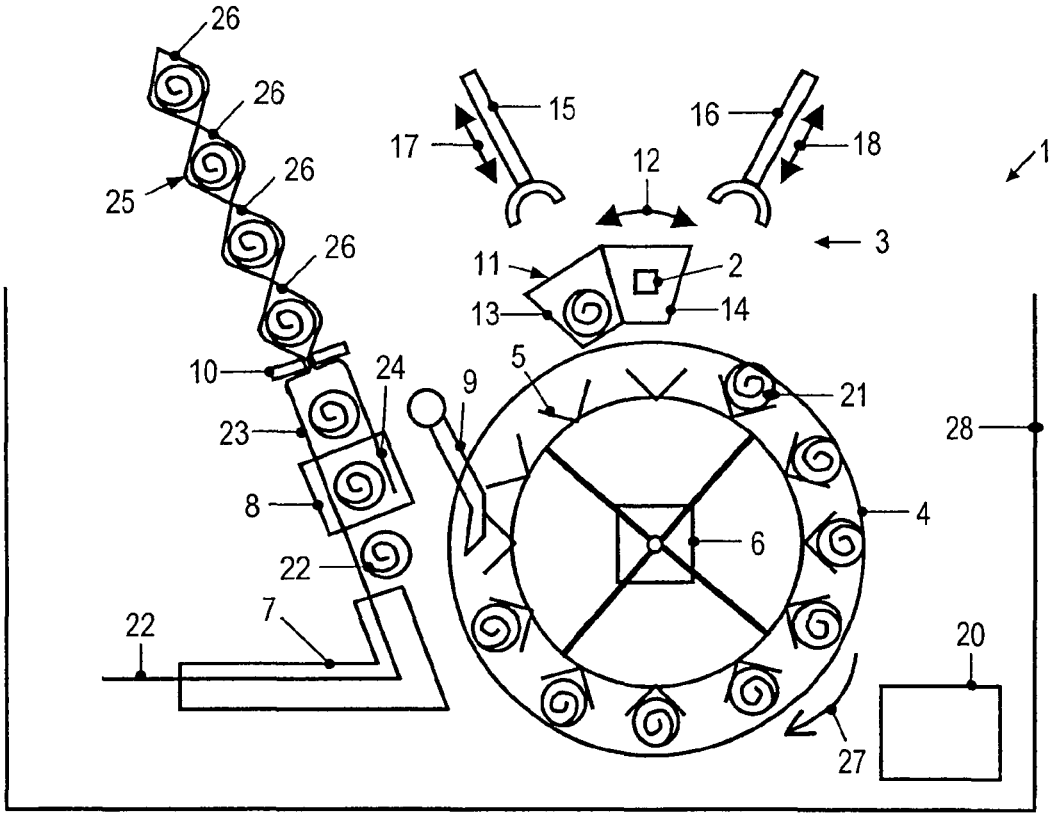
FIG. 1 is a schematic representation of a machine for producing a string of pocket springs according to an embodiment.

FIG. 1 is a schematic representation of a machine 1 for producing a string of pocket springs according to an embodiment. The machine 1 comprises a spring coiling device having a coiling head 2, an apparatus 3 for transferring the springs from the winding head 2 to a spring conveyor, a spring conveyor which is configured as a transport wheel 4 and which has a drive 6, and a device for pocketing the springs, which are mounted on a frame 28 of the machine. In operation of the apparatus, springs which are formed by the coiling head 2 of the spring coiling device are transferred by the apparatus 3, which will be explained in more detail in the following, to the transport wheel 4. The transport wheel 4 has a plurality of receptacles 5, in which a spring 21 may respectively be received. The drive 6 continuously drives the transport wheel 4 in a direction 27. Here, the direction 27 is selected such that the springs cool down during transport from the winding head 2 to the device for pocketing the springs, such that the transport wheel 4 acts as a cooling wheel in which the springs cool down after a heat treatment and prior to pocketing the springs. In this case, the wire may be heated before the springs are formed or the formed springs may be subjected to a heat treatment, for example. The springs are subsequently pocketed in the device for pocketing the springs, with a string 25 of pocket springs being formed which has a plurality of pocket springs 26. The term string of pocket springs is generally used to refer to a plurality of pockets which are attached to each other and which have pocketed springs therein.

An implementation of the device for pocketing the springs in the machine of an embodiment will be described in the following. The device for pocketing the springs has a guide device 7 for a supplied web-shaped pocket material 22, for example a non-woven fabric. The guide device 7 may be configured such that it folds up edge portions of the web of pocket material 22 before the springs are inserted into the web 22 of material. Transfer means 9 which may, for example, have one or plural pivot arms transfer respectively one spring from a receptacle of the transport wheel 4 to the web 22 of material. In a device 8, the pocket material is overlayed onto the inserted springs 22 in a tube-shape after insertion of the spring 22, such that the springs are interposed between layers 23, 24 of the pocket material. In the device 8, the pocket material folded in a tube-shape may be joined using a longitudinal seam in the longitudinal direction of the web, for example by means of ultrasonic welding. Thereafter, the transverse seams between the pockets are formed by ultrasonic welding using an ultrasonic welding device, the ultrasonic horn 10 of which is schematically shown, in order to form pockets for the pocketed springs 26 of the string 25 of pocket springs. While an implementation of a device for pocketing springs has been described with reference to FIG. 1, machines for producing strings of pocket springs according to other embodiments may be provided with pocket forming devices having alternative configurations.

The construction and operation of the apparatus 3 for transferring springs according to various embodiments will be described in more detail in the following. The apparatus 3 comprises a transfer device 11 which has a plurality of portions 13, 14, in which the transfer device 11 may respectively receive a spring. The portions 13, 14 may have chamber-shape configurations and may respectively be delimited by a pair of walls on at least two sides, wherein a spring can respectively be received in the cavity defined between the walls. The transfer device 11 is mounted so as to be moveable, such that it can be moved between a first and a second position as schematically indicated by arrow 12. In the first position, the transfer device is arranged such that the first portion 13 receives a spring formed by the coiling head 2. In the second position shown in FIG. 1, the transfer device is arranged such that the second portion 14 receives a spring formed by the coiling head 2.

The apparatus 3 for transferring the springs further comprises an output device which outputs a spring received by the transfer device 11 from the transfer device at one of plural output positions. The output device may have a pair of pushers 15, 16 which are mounted so as to be displaceable, as indicated by arrows 17, 18. The output device is configured such that in each one of the plurality of positions in which the transfer device 11 receives a spring in one of its portions 13, 14, a spring which has been received in the other portion 13, 14 of the transfer device 11 is output from the transfer device 11 to the transport wheel 4 by actuation of one of the pushers. The output positions are pairwise spaced from each other. In particular, a spring which is formed by the coiling head 2 in the second position of the transfer device 11 shown in FIG. 1 and which is received in the second portion 14 of the transfer device 11, is output from the transfer device 11 at a second output position which is spaced, in a circumferential direction along the transport wheel 4, from the first output position at which the spring received in the first portion 13 is output from the transfer device 11, as shown in FIG. 1.

The apparatus 3 for transferring the springs has at least one drive mechanism (not shown), by means of which the transfer device is pivoted in the conveying direction of the transport wheel 4 and opposite to the conveying direction of the transport wheel 4 in an alternating manner, and by means of which the pushers 15, 16 of the output device are displaced such that, when one of the two positions is reached in which the transfer device 11 receives another spring, a spring received in the transfer device 11 is output from the transfer device 11. The drive mechanism or the drive mechanisms, respectively, of the apparatus 3 may be suitably controlled by a controller 20 of the machine 1. In this case, the control may be implemented as a function of an angular position of the transport wheel 4 and/or as a function of a working frequency of the pocket forming device 7-10.

With reference to FIG. 2-5, the configuration and operation of the apparatus for transferring springs to a spring conveyor according to various embodiments will be described in more detail. The apparatus described with reference to FIG. 2-5 may be used in the machine 1 as apparatus 3. Elements or devices which correspond, as regards construction or function, to elements or devices described with reference to FIG. 1 are designated with the same reference numerals.

FIG. 2A-2F are schematic representations of an apparatus 30 for transferring springs to a spring conveyor. The apparatus 30 comprises a transfer device 31, with the transfer device in a first position being labelled by 31*a* in FIGS. 2A and 2F, and the transfer device in a second position being labelled 31*b* in FIGS. 2C and 2D for clarity. The transfer device 31 has two portions 32, 33 which are respectively configured to receive a spring. The portions 32, 33 may be formed to have a chamber shape, for example, with a first pair of sidewalls 34, 36 defining the first portion 32 for receiving a spring, and with a second pair of sidewalls 35, 36 defining the second portion 33 for receiving a spring. The transfer device 31 is mounted so as to be pivotable about an axis 38. A drive 39*a* is operatively coupled to the transfer device 31 to alternatingly move the transfer device in a first direction 46 and a second direction 48 between the two positions 31*a*, 31*b* in which the transfer device 31 respectively receives a spring.

The apparatus 30 comprises a wall section 37. The wall section 37 is formed such that it acts as a floor of at least one of the portions 32, 33, depending on its position relative to the transfer device 31. The wall section 37 is mounted so as to be pivotable about the axis 38 and is moved by a drive 39*b* such that the wall section 37 supports a spring received in one of the portions 32, 33 during movement of the transfer device 31 between the positions 31*a*, 31*b* in the respective portion 32, 33. The wall section 37 thus acts as a retaining means for the spring. In combination with the sidewall 36, the wall section 37 defines the respective cavities for receiving a spring.

The apparatus 30 comprises an output device to output a spring received by the transfer device from the transfer device. The output device is configured such that in each one of the positions 31*a*, 31*b* of the transfer device in which the transfer device receives a spring in one of its portions 32, 33, the output device outputs a spring received in the other one of the portions 32, 33 from the transfer device. The output device may have a pair of pushers 15, 16 which are mounted so as to be displaceable, and the ends of which are configured to enter into the portions 32, 33 of the transfer device 31 and to output a spring from the transfer device which has been received therein. The output device is provided with a drive 40 (shown in FIG. 2A only) which may move the pushers 15, 16 as a function of the position of the transfer device such that either the pusher 15 or the pusher 16 enters into one of the portions 32, 33 of the transfer device 31.

In operation of the apparatus 30 for transferring springs, a spring may selectively be received by the transfer device 31 in one of the positions 31*a*, 31*b*. Depending on the position in which the spring is received, the spring is received in one of the portions 32, 33 of the transfer device. The spring may in particular be formed by the coiling head 2 in the respective portion 32, 33. After receiving the spring, the transfer device 31 is moved, with the received spring being transported by the transfer device 31 to an output position. In this process, the wall section 37 supports the spring in a form fit. Depending on in which one of the positions 31*a*, 31*b* the spring was received, the transfer device may be moved in a first direction 46 or in a second direction 48 opposite thereto to transport the received spring to the output position. Depending on whether the spring was received in the first position or in the second position 31*a*, 31*b* of the transfer device, the spring is output from the transfer device at a first output position or at a second output position which is spaced therefrom. Another spring is received in another portion 32, 33 of the transfer device concurrently with outputting the spring.

The operation of the apparatus will be explained in more detail with reference to FIG. 2A-2F.

Figure 2A:
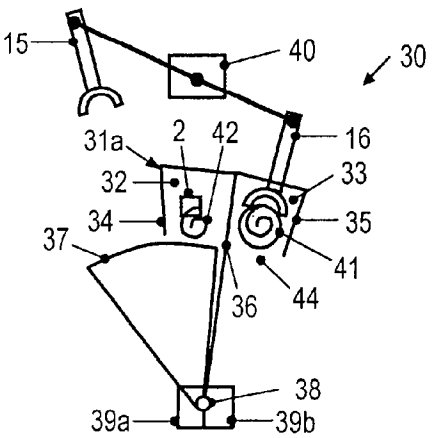
FIG. 2A-2F are schematic representations of an apparatus for transferring springs according to an embodiment at different times during operation of the apparatus.

FIG. 2A shows an operating state of the apparatus 30 in which the transfer device 31 is located in the first position 31*a*. A spring 42 formed by the coiling head 2 is received in the first portion 32 of the transfer device 31. The wall section 37 is positioned such that it at least partially closes the chamber formed by the first portion 31 in a downward direction, i.e., towards the spring conveyor. The wall section 37 may support the spring 42 formed in the first portion 32 already during the forming process to reduce oscillations of the spring 42. A spring 41 formed during the preceding working cycle which is received in the second portion 33 of the transfer device 31 is output from the transfer device 31, wherein outputting the spring 41 may be performed concurrently with forming the spring 42. The wall section 37 is positioned such that it allows the spring 41 to pass out of the second portion 33 of the transfer device 31 to the spring conveyor. The pusher 16 is displaced by the drive 40 such that it outputs the spring 41 from the second portion 33 of the transfer device 41 to the spring conveyor. When the transfer device 31 is in the first position 31*a*, the position of the second portion 33 defines a second output position 44 in which the spring 41 which was received in the second position 31*b* is output from the transfer device 31.

Figure 2B:
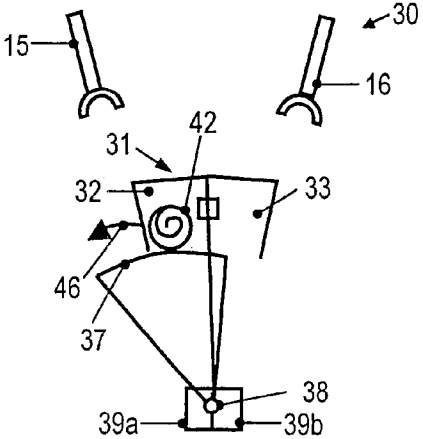

FIG. 2B shows an operating state after the spring 41 has been output and after the spring 42 has been formed. The transfer device 31 is moved in a first direction 46 from the first position 31*a* into the second position 31*b*. The first direction 46 may be anti-parallel to a movement direction of the spring conveyor. During movement of the transfer device from the first position 31*a* into the second position 31*b*, the spring 42 received in the first portion 32 of the transfer device 31 is transported along by the transfer device 31 in the first portion 32. The wall section 37 is positioned such that it supports the spring 42 in the first portion in a form fit while the transfer device 31 is moved from the first position 31*a* into the second position 31*b*.

Figure 2C:
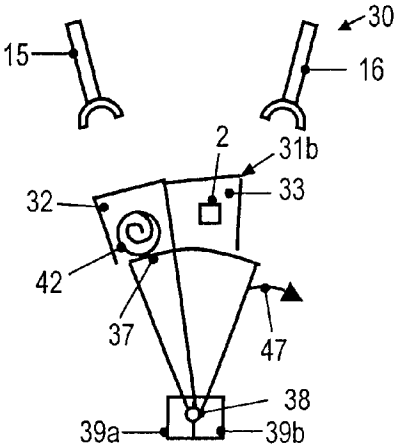

FIG. 2C shows an operating state in which the transfer device has reached the second position 31*b*. The wall section 37 is moved from the position shown in FIGS. 2A and 2B, in which it at least partially delimits the first portion 32 of the transfer device 31 in a downward direction, so that outputting the spring 42 from the transfer device 31 is made possible. For this purpose, the wall section 37 may be moved such that, by movement of the wall section 37, the floor of the chamber defined by the first portion 32 is opened and the floor of the chamber defined by the second portion 33 is closed. The wall section 37 may be moved in a second direction 47 which is opposite to the first direction 46 in which the transfer device 31 has previously been moved from the first position 31*a* to the second position 31*b*.

After the wall section 37 has been moved such that the floor of the chamber defined by the first portion 32 is opened and the floor of the chamber defined by the second portion 33 is at least partially closed, a working cycle of the apparatus is completed. The spring 42 may be output from the transfer device 31, while another spring 43 is concurrently received in the second portion 33 of the transfer device, as will be explained with reference to FIG. 2D-2F.

Figure 2E:
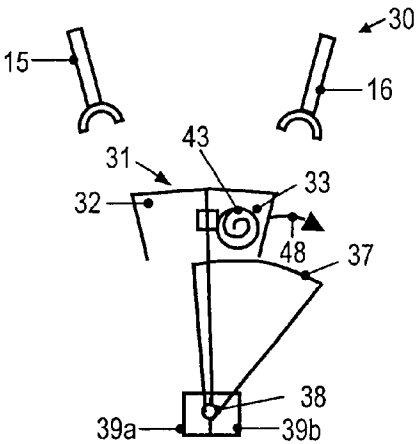
Figure 2F:
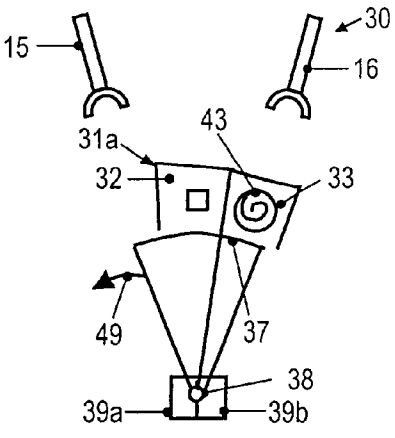
Figure 2D:
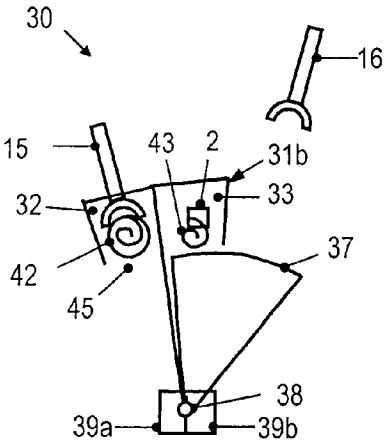

FIG. 2D shows an operating state of the apparatus 30 in which the transfer device 30 is in the second position 31*b*. The wall section 37 is positioned such that the floor of the chamber defined by the first portion 32 is opened and that the floor of the chamber defined by the second portion 33 is at least partially closed. The spring 42 which is received in the first portion 32 of the transfer device 31 is output from the transfer device 31, wherein the outputting of the spring 42 may be performed concurrently with forming the other spring 43. The wall section 37 is positioned such that it allows the spring 42 to pass out of the first portion 32 of the transfer device 31 to the spring conveyor. The pusher 15 is displaced by the drive 40 such that it outputs the spring 42 from the first portion 32 of the transfer device 31 to the spring conveyor. When the transfer device 31 is in the second position 31*b*, the position of the first portion 32 defines the first output position 45 in which the spring 42 which was received in the first position 31*a* is output from the transfer device 31. The other spring 43 formed by the coiling head 2 is received in the second portion 33 of the transfer device 31. The wall section 37 is positioned such that it at least partially closes the chamber formed by the second portion 33 in a downward direction, i.e. toward the spring conveyor. The wall section 37 may support the other spring 43 in the second portion 33 already during the forming process to reduce oscillations of the other spring 43.

FIG. 2E shows an operating state after the spring 42 has been output and after the other spring 43 has been formed. The transfer device 31 is moved in the second direction 48 from the second position 31*b* into the first position 31*a*. The second direction 48 may be parallel to a movement direction of the spring conveyor. During movement of the transfer device 31 from the second position 31*b* into the first position 31*a*, the other spring 43 received in the second portion 33 of the transfer device 31 is transported along by the transfer device 31 in the second portion 33. The wall section 37 is positioned such that it supports the other spring 43 in the second portion 33 in a form fit while the transfer is moved from the second position 31*b* into the first position 31*a*.

FIG. 2F shows an operating state in which the transfer device has reached the first position 31*a*. The wall section 37 is moved from the position shown in FIGS. 2D and 2E in which it at least partially closes the second portion 33 of the transfer device 31 in a downward direction, such that it allows the other spring 43 to be output from the transfer device 31. For this purpose, the wall section 37 may be moved such that, by virtue of the movement of the wall section 37, the floor of the chamber defined by the second portion 33 is opened and the floor of the chamber defined by the first portion 32 is closed. The wall section 37 may be moved in a first direction 49 which is opposite to the second direction 48 in which the transfer device 31 has previously been moved from the second position 31*b* into the first position 31*a*.

The apparatus 30 may subsequently run through the two working cycles described with reference to FIG. 2A-2F again.

Because the apparatus 30 according to the embodiment can output springs 42, 43 which are sequentially received by the transfer device at different output positions 45, 44 from the transfer device 31, the final state of one working cycle for transferring a spring in which the spring is output may simultaneously serve as an initial state of another working cycle in which another spring is received. A return movement of the transfer device without a spring supported thereon is not necessarily required as a separate process step in continuous operation. The other spring may be received concurrently with outputting the spring which has previously been transported to an output position so as to enable a further increase of a rate at which springs are transferred by the apparatus 30.

In the apparatus 30, the moveable wall section 37 acts as a trap-door mechanism which allows a spring to be output from one of the portions 32, 33 of the transfer device 31 and which can support another spring received in another portion of the portions 32, 33 of the transfer device 31 during formation of the spring and during transport of the spring.

In the apparatus 30, the drives 39*a*, 39*b*, 40 for the transfer device 31, the moveable wall section 37 and the output device 15, 16 may be suitably controlled to sequentially run through the operating states described to reference to FIG. 2. The control may be performed by the control unit 20 of the machine 1 of FIG. 1 for producing a string of pocket springs in which the apparatus 30 can be used. The control of the transfer device 31, of the moveable wall section 37 and of the output devices 15, 16 may be performed as a function of and coordinated with the movement of the spring conveyor to attain a desired arrangement of springs on the spring conveyor. If the spring conveyor is moved continuously, the control of the transfer device 31, of the moveable wall section 37 and of the output devices 15, 16 may be performed as a function of and coordinated with the speed of a spring conveyor. Thereby, springs can be transferred to the spring conveyor by the apparatus such that they are arranged at equal distances on the spring conveyor.

With reference to FIG. 3, transfer of plural springs to a spring conveyor will be described in more detail. FIG. 3A-3D show a schematic representation of an apparatus 50 for transferring springs to a spring conveyor 4 according to an embodiment.

Figure 3A:
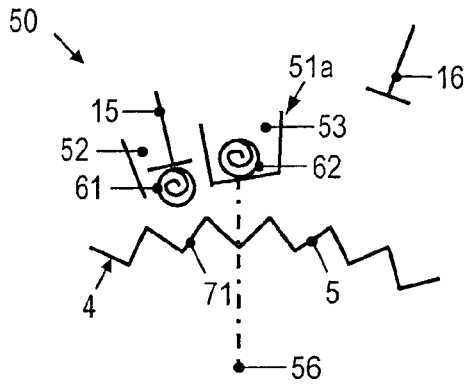
FIG. 3A-3D are schematic representations of an apparatus for transferring springs according to an embodiment at different times during operation of the apparatus.
Figure 3B:
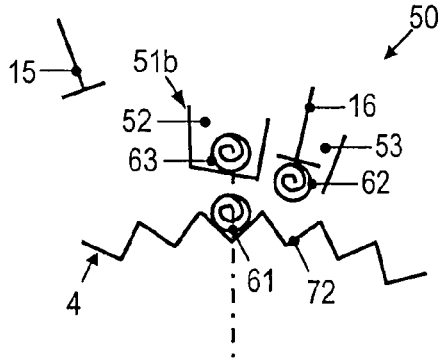
Figure 3C:
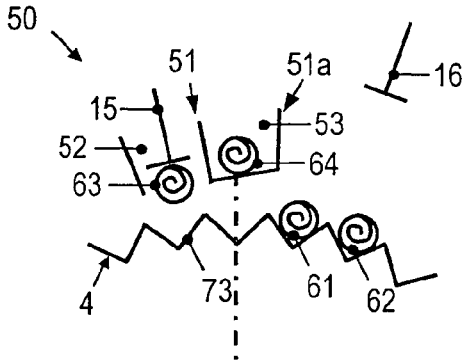
Figure 3D:
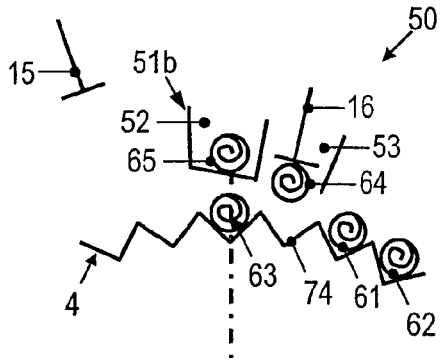

The apparatus 50 comprises a transfer device 51, with the transfer device in a first position being designated by 51*a* in FIGS. 3A and 3C, and the transfer device in a second position being designated by 51*b* in FIGS. 3B and 3D for clarity. The transfer device 51 has two portions 52, 53 which are respectively configured to receive a spring. The portions 52, 53 may be formed to have a chamber shape, for example. The transfer device 51 is mounted so as to be moveable relative to an axis 56, which may be determined by the position of the coiling head of a spring coiling device, for example, and is moveable between the two positions 51*a*, 51*b* in which the transfer device 51 respectively receives a spring. The apparatus 50 comprises an output device to output a spring received by the transfer device from the transfer device. The output device may comprise a pair of moveably supported pushers 15, 16, the ends of which are configured to enter into the portions 52, 53 of the transfer device 51 and to output a spring received therein from the transfer device. The apparatus 50 may further comprise a wall section which is mounted so as to be moveable relative to the transfer device 51 or other retaining means which support a spring during movement of the transfer device 51 on the transfer device by force locking or form locking. The other configuration of the apparatus 50 may for example correspond to the configuration of the apparatus 30 described with reference to FIG. 2 or to the configuration which will be described for the apparatus 80 with reference to FIG. 4 below.

In the operating state shown in FIG. 3A, the transfer device 51 is positioned in the first position 51*a*. A spring 61 received in the first portion 52 is output by the pusher 15 to the spring conveyor 4, while another spring 62 is received in the second portion 53 of the transfer device 51. The pusher 15 outputs the spring 61 at a second output position 54 to the spring conveyor 4, such that the spring 61 is output to a first position 71 of the spring conveyor 4. The first position 71 at which the spring conveyor 4 receives the spring 41 from the apparatus 50 may for example be defined by a receptacle of a plurality of receptacles 5 which are provided on the spring conveyor 4 for receiving springs.

After the spring 61 has been output to the spring conveyor 4 and the other spring 62 has been received in the second portion 53, the transfer device 50 is moved from the first position 51*a* shown in FIG. 3A into the second position 51*b* shown in FIG. 3B. In the second position 51*b* of the transfer device, both the first portion 52 and the second portion 53 of the transfer device in which a spring may respectively be received are located at other locations in space as compared to the first position 51*a* of the transfer device 51. In particular, in the second position 51*b* of the transfer device, the second portion 53 of the transfer device 51 is displaced away from the position located on the axis 56 at which a spring is received, while the first portion 52 is positioned such that it can receive a spring.

The spring conveyor 4 progresses while the transfer device 51 is moved between the first position 51*a* and the second position 51*b*.

In the operating state shown in FIG. 3B, the transfer device 51 is in the second position 51*b*. The other spring 62 received in the second portion 53 is output by the pusher 16 to the spring conveyor 4, while a third spring 63 is received in the first portion 52 of the transfer device 51. The pusher 16 outputs the other spring 62 at a first output position 55 to the spring conveyor 4, such that the other spring 62 is handed over to a second position 72 of the spring conveyor 4. As shown in FIG. 3B, the other spring 62 which has been wound later than the spring 61 may be handed over to the spring conveyor such that it is positioned thereon at a position 72 which is arranged downstream, in a transport direction, of the spring 61 which has been wound first.

While the spring conveyor 4 progresses, the transfer device 51 is returned to the first position 51*a* again, as shown in FIG. 3C. The cycle of the apparatus 50 is in this case selected such that the spring conveyor progresses by a distance or angular distance, respectively, which corresponds to the portion provided on the spring conveyor for two springs 61, 62 until the transfer device 51 is again positioned in the first position 51*a* to output the third spring 63. In the operating state shown in FIG. 3C, the third spring 63 received in the first portion 52 is output by the pusher 15 to the spring conveyor 4, while a fourth spring 64 is received in the second portion 53 of the transfer device 51. The pusher 15 outputs the third spring 63 at the second output position 54 to the spring conveyor 4, such that the third spring 63 is handed over to a third position 73 of the spring conveyor 4. As shown in FIG. 3C, the third spring 63 which has been received by the transfer device 51 immediately after the other spring 62 may be handed over to the spring conveyor such that it is positioned thereon at a position 74 which defines a gap to the position 71 of the spring 61. The fourth spring 64 is positioned in the gap between the first and third springs 61, 63 on the spring conveyor in a subsequent working cycle.

While the spring conveyor 4 progresses, the transfer device 51 is again moved into the second position 51*b*, as shown in FIG. 3D. In the operating state shown in FIG. 3D, the fourth spring 64 received in the second portion 53 is output by the pusher 16 to the spring conveyor 4, while a fifth spring 65 is received in the first portion 52 of the transfer device 51. The pusher 16 outputs the fourth spring 64 at the first output position 55 to the spring conveyor 4 such that the fourth spring 64 is handed over to a fourth position 74 of the spring conveyor 4 and is positioned between the springs 61 and 63 which are already arranged on the spring conveyor 4.

Subsequently, the described processes may be repeated to continue transferring springs to the spring conveyor 4. In order to receive the springs, the springs may respectively be formed in the respective portion 52 or 53 of the transfer device 51.

The apparatus 50 for transferring springs allows springs to be positioned on the continuously moving spring conveyor 4 in equal distances. A high rate at which springs are transferred to the spring conveyor 4 can be attained, because the transfer device 51 of the apparatus 50 is configured, in each one of the plurality of the positions 51*a*, 51*b*, to receive a spring and to output another spring at one of plural output positions.

Figure 3E:
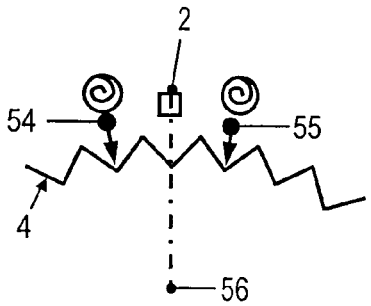
FIG. 3E is a schematic representation for explaining the operation.

FIG. 3E is a schematic representation which illustrates for apparatus 50 that springs received by the transfer device 51 can be handed over to the spring conveyor at one of plural output positions 54, 55 in an alternating fashion. Here, the first output position 55 is the output position at which springs are output which were received by the transfer device in the first position 51*a* (as shown in FIGS. 3A and 3C), after the transfer device was moved to the second position 51*b* (as shown in FIGS. 3B and 3D). The second output position 54 is the output position at which springs are output which were received by the transfer device in the second position 51*b*. The output positions 54, 55 are provided so as to be spaced from each other and spaced from the position at which the transfer device receives a spring and which may be determined by the position of the coiling head 2, for example.

Figure 4:
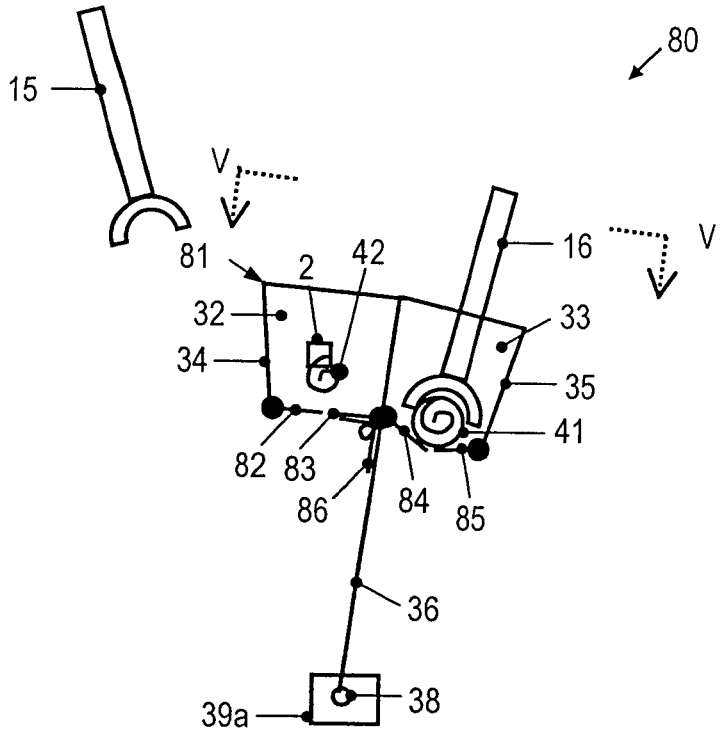
FIG. 4 is a schematic representation of an apparatus for transferring springs according to another embodiment.

FIG. 4 is a schematic representation of an apparatus 80 for transferring springs to a spring conveyor according to another embodiment. Elements or devices of the apparatus 80 which correspond, with regard to their construction or operation, to elements or devices which were explained for the apparatus 30 with reference to FIG. 2 are designated with the same reference numerals.

The apparatus 80 has a transfer device 81 with two chamber-shaped portions 32, 33 and an output device having pushers 15, 16.

The apparatus 80 has retaining means which support a spring in a form fit while the transfer device 81 is moved between two positions in which it is respectively configured to receive a spring and to output another spring. In the apparatus 80, the retaining means comprise at least one flap 82, 83 which is pivotably supported on the transfer device 81 and which is biased, for example using a resilient means 86, such that it supports the spring in the first portion 32 of the transfer device 81 and prevents the spring from exiting the first portion 32 of the transfer device 81 until the pusher 15 exerts an additional force to open the at least one flap 82, 83. The retaining means further comprise at least one flap 84, 85 which is pivotably supported on the transfer device 81 and which is biased, using for example a resilient means, such that it supports the spring in the second portion 33 of the transfer device 81 and prevents the spring from exiting the second portion 33 of the transfer device 81 until the pusher 16 exerts an additional force to open the at least one flap 84, 85.

The apparatus for transferring springs according to the various described embodiments may be configured such that the transfer device may be adapted to springs having different heights. Alternatively or additionally, the apparatus for transferring springs according to the various described embodiments may be configured such that the spring is subjected to additional processes while it is received in the transfer device. For illustration, a device may be provided which compresses the spring received in the transfer device before it is output from the transfer device to a desired axial length, as will be described with reference to FIG. 5.

Figure 5:
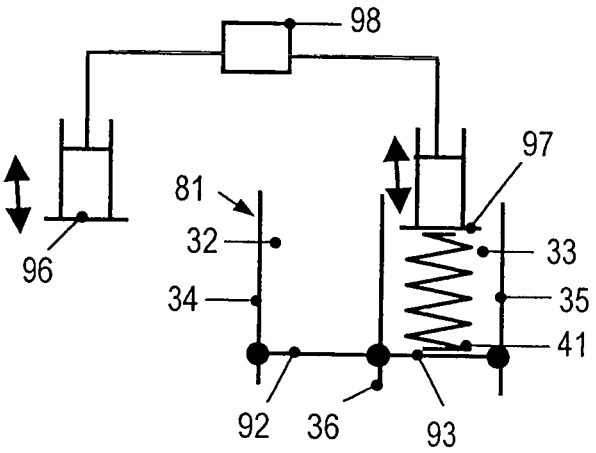
FIG. 5 is a schematic plan view of the apparatus of FIG. 4.

FIG. 5 is a schematic plan view of the transfer device 81 along the direction indicated at V-V in FIG. 4. A corresponding configuration may also be provided in the transfer devices described with reference to FIG. 1-3.

The portions 32, 33 of the transfer device 81 in which springs can be received when the transfer device 81 is in the first and second position, respectively, are delimited by sidewalls 34 and 36 and sidewalls 35 and 36, respectively, which extend parallel to a longitudinal axis of the spring. An end wall 92 which delimits the portion 32 in a longitudinal direction of the spring to be received and the sidewalls 34 and 36 are configured such that the end wall 92 may be mounted to the sidewalls 34 and 36 at different positions to adjust the portion 32 to different spring lengths. An end wall 93 which delimits the portion 33 in a longitudinal direction of the spring to be received and the sidewalls 35 and 36 are configured such that the end wall 93 may be mounted to the sidewalls 35 and 36 at different positions to adapt a portion 33 to different spring lengths.

There is provided a device for axially compressing a spring received by the transfer device. The device has a first contact surface 96 and a second contact surface 97 which are respectively mounted so as to be displaceable parallel to the longitudinal axis of the spring which is to be axially compressed. The first contact surface 96 is arranged such that it can be engaged with an end coil or an end ring of a spring received in the first portion 32 of the transfer device 81 before the spring is output from the transfer device 81. The second contact surface 97 is arranged such that it can be engaged with an end coil or an end ring of a spring received in the second portion 33 of the transfer device 81 before the spring is output from the transfer device 81. An actuator 98 is provided to displace the contact surfaces 96 and 97 parallel to the longitudinal axis of the received spring such that the spring is axially compressed before it is output from the transfer device.

If the device for axially compressing the spring is used in the apparatus 30 of FIG. 2, the actuator 98 may be controlled such that the spring received in one of the portions 32, 33 is axially compressed while the wall section 37 is moved such that the floor of the respective portion 32, 33 of the transfer device is opened for outputting the respective spring.

Apparatus and methods for transferring springs to a spring conveyor according to various embodiments have been described with reference to the drawings. Modifications of the embodiments which were described in detail may be implemented in other embodiments.

While transfer devices have been described in the context of embodiments which are configured to receive springs in two positions, in other embodiments the transfer device may also be configured such that it can respectively receive a spring in at least three different positions, while another spring is output from the transfer device in parallel thereto. Accordingly, in other embodiments, the transfer device may have at least three portions on which a spring may be received.

While transfer devices have been described in the context of embodiments which have plural cavities delimited by plural sidewalls, in other embodiments the transfer device may comprise a plurality of cavities which are respectively delimited by at least two walls. The at least two walls may for example comprise a wall which is arranged between the cavities and a moveably mounted floor section.

While transfer devices have been described in the context of embodiments which have plural cavities delimited by at least two walls, in other embodiments the transfer device may also be configured such that the various portions for receiving springs are not formed as cavities delimited by walls. In particular, the terms "receiving" and "outputting" of a spring used herein are not to be construed in a limiting sense to mean that a cavity or a chamber for receiving the spring must necessarily be provided. For example, in other embodiments the transfer device may have a plurality of mandrels which are spaced from each other, wherein each of the mandrels can receive a spring in one of the positions of the transfer device. The mandrels may be moveably mounted to release a spring at one of the plural output positions.

While apparatus for transferring springs have been described in the context of embodiments in which the output device comprises one or plural pushers, other configurations of the output device are possible. For example, the output device may also be configured by retaining means which support the spring during movement of the transfer device and which release the spring when the output position is reached. The spring may then move under the influence of gravity from the transfer device to the spring conveyor, for example.

While apparatus for transferring springs have been described in the context of embodiments in which the springs to be transferred are formed by a coiling head in a portion of the transfer device, in other embodiments the transfer device may be configured such and may be arranged such in a machine that it receives a spring which has already been finished.

While apparatus for transferring springs have been described in the context of embodiments in which the transfer device is mounted so as to be pivotable, in other embodiments the transfer device may also be mounted so as to be displaceable in a translatory fashion, in particular linearly, in order to move between the various positions. A linear movement of the transfer device between the positions may for example be provided to transfer springs to a transport wheel having a large diameter, to a conveyor belt or to a pair of conveyor belts.

While apparatus, methods and machines have been described in the context of embodiments in which the springs are directly handed over to a spring conveyor by the apparatus for transferring springs, in other embodiments additional devices or stations may be provided between the apparatus for transferring the springs and the spring conveyor.

The apparatus and methods according to various embodiments of the invention allow springs to be transferred to a spring conveyor at a high rate, because winding the spring and transferring the spring to the spring conveyor are decoupled. The apparatus and methods may generally be used for transferring springs, wherein transferring springs to a cooling wheel in a machine for producing strings of pocket springs is an exemplary field of use.

The invention claimed is:

1. An apparatus for transferring springs to a spring conveyor, the apparatus comprising:

a transfer device which is mounted so as to be moveable between a plurality of positions in which the transfer device is respectively configured to receive a spring, the transfer device being configured to transport a received spring upon movement of the transfer device between at least two positions of the plurality of positions; and an output device to selectively output the spring that has been received by the transfer device to discharge the spring from the transfer device at one of a plurality of output positions while the transfer device concurrently receives another spring, the plurality of output positions being different from each other, wherein the transfer device is mounted so as to be pivotable back and forth between the at least two positions, and further including a transport wheel having a plurality of receptacles, wherein at each output position of the plurality of output positions a spring is transferrable to a receptacle of the plurality of receptacles, and further wherein the transport wheel is operable as a spring conveyor.

2. The apparatus according to claim 1, wherein the transfer device is configured to transport the received spring selectively in a first direction or in a second direction different from the first direction, in particular in a second direction which is opposite to the first direction.

3. The apparatus according to claim 1, wherein the apparatus is configured such that each output position of the plurality of output positions is associated with respectively one position of the transfer device in which the spring that is output at the respective output position has been received by the transfer device.

4. The apparatus according to claim 1, further comprising:

retaining means to support the spring received by the transfer device in a form fit.

5. The apparatus according to claim 4, wherein the retaining means are controllable to release the spring received by the transfer device in dependence on a position of the plurality of positions in which the transfer device is positioned.

6. The apparatus according to claim 4, wherein the transfer device has a cavity to receive the spring, and the retaining means comprise a wall section of the cavity which is displaceable relative to the cavity.

7. The apparatus according to claim 1, further comprising:

a spring coiling device configured to form a spring which is to be received by the transfer device at a location at which the transfer device supports the spring while it is being formed.

8. The apparatus according to claim 1, wherein the apparatus is configured for use in a machine for producing a string of pocket springs.

9. A machine for producing a string of springs for a spring core, in particular for producing at least one string of pocket springs, the machine comprising:

a spring conveyor to convey springs; and an apparatus according to claim 1 to transfer the springs to the spring conveyor.

10. The apparatus of claim 1, further comprising:

a retaining means configured to support the spring received by the transfer device in a form fit while the transfer device is moved between two positions of the plurality of positions, the retaining means being configured such that a force exerted by the retaining means onto the spring is directed transverse to a longitudinal axis of the spring.

11. The apparatus according to claim 10, wherein the apparatus comprises a trap-door mechanism which is selectively opened when the spring received by the transfer device is to be output from the transfer device.

12. A method of transferring springs to a spring conveyor, the method comprising:

receiving, by a transfer device mounted so as to be moveable between a plurality of positions in which the transfer device is respectively configured to receive a spring, a spring;

moving the transfer device to transport the spring between at least two positions of the plurality of positions, the transfer device pivotable back and forth between the at least two positions;

selectively outputting the spring received by the transfer device at one of a plurality of output positions, the plurality of output positions being different from each other, while the transfer device concurrently receives another spring; and at each output position of the plurality of output positions, transferring the spring to a receptacle of a plurality of receptacles of a transport wheel, the transport wheel operable as a spring conveyor.

13. The method according to claim 12, wherein moving the transfer device includes selectively moving the transfer device in a first direction or in a second direction different from the first direction, wherein the second direction is opposite to the first direction.

14. The method according to claim 13, wherein selectively moving the transfer device in the first direction or in the second direction is based on the one of a plurality of positions of the transfer device during the receiving.

15. The method according to claim 14, wherein moving the transfer device to transport the spring includes sequentially moving the transfer device in opposite directions to transport the first spring and to transport the second spring.

16. The method according to claim 12, wherein moving the transfer device to transport the spring further includes supporting the spring on the transfer device in a form fit.

17. The method according to claim 16, wherein supporting the spring on the transfer device in a form fit includes supporting the spring with a retaining means while the spring is being formed.

18. The method according to claim 12, wherein the method is performed in a machine for producing a string of pocket springs.

* * * * *